United States Patent [19]

Shimizu

[11] Patent Number: 4,979,877

[45] Date of Patent: Dec. 25, 1990

[54] WOBBLE PLATE TYPE REFRIGERANT COMPRESSOR

[75] Inventor: Shigemi Shimizu, Sakai, Japan

[73] Assignee: Sanden Corporation, Gunma, Japan

[21] Appl. No.: 447,430

[22] Filed: Dec. 7, 1989

[30] Foreign Application Priority Data

Dec. 9, 1988 [JP] Japan ..... 63-159478[U]

[51] Int. Cl.[5] ..... F04B 1/26; F01B 31/10

[52] U.S. Cl. ..... 417/222; 417/269; 92/71; 92/154

[58] Field of Search ..... 184/6.17; 417/222, 222.5, 417/269; 92/12.2, 71, 153, 154

[56] References Cited

U.S. PATENT DOCUMENTS 4,475,871 10/1984 Roberts ..... 417/222.3
4,506,648 3/1985 Roberts ..... 92/12.2
4,913,626 4/1990 Terauchi ..... 417/272

FOREIGN PATENT DOCUMENTS 2303969 8/1976 France ..... 417/269
65177 3/1988 Japan ..... 417/269

*Primary Examiner*—Leonard E. Smith

*Assistant Examiner*—John A. Savio, III

*Attorney, Agent, or Firm*—Banner, Birch, McKie & Beckett

[57] ABSTRACT

A wobble plate type refrigerant compressor including a compressor housing having a cylinder block is disclosed. A plurality of peripherally located cylinders are formed through the cylinder block. A piston is slidably fitted in each of the cylinders and is reciprocated by a drive mechanism which includes a slant plate. The slant plate includes a boss for mounting a wobble plate and balance weight ring thereon. The balance weight ring prevents the axial movement of the wobble plate during operation of the compressor. The balance weight ring includes a centrally located thin plate region defining a recessed portion. The balance weight ring includes a plurality of holes formed at the thin plate region and an annular side wall of the recessed portion tapered to provide sufficient lubrication to the friction surface between the wobble plate and the thin plate region of the balance weight ring during compressor operation. The balance weight ring can rotate smoothly on the wobble plate without the need for a bearing between the wobble plate and the thin plate region of the balance weight ring.

12 Claims, 3 Drawing Sheets

WOBBLE PLATE TYPE REFRIGERANT COMPRESSOR

BACKGROUND OF THE INVENTION

1. Technical Field

The present invention relates to a refrigerant compressor, and more particularly, to a wobble plate type refrigerant compressor for use in an automotive air conditioning system.

2. Description of the Prior Art

As disclosed in Japanese Patent Application No. 64-29678, a slant plate type compressor, such as a wobble plate type compressor, includes a balance weight ring of substantial mass disposed on the nose of the hub or "boss" of the slant plate, in order to balance the slant plate under dynamic operation conditions. The balance weight ring is held in place by means of a retaining ring.

FIG. 5 shows a slant plate type compressor as disclosed in the Japanese application. Wobble plate 60 is mounted about boss 54 of slant plate 50 through bearings 61 and 62 so that slant plate 50 is rotatable with respect respect thereto. Boss 54 includes smaller diameter portion **54*a* at an axially rearward end (to the right in FIG. 5) thereof, resulting in the formation of annular shoulder 541 forward of portion 54*a*. Wobble plate 60 includes annular projection 601 formed at an inner periphery of the axially rearward surface thereof and terminated so as to be same axial level of annular shoulde 541. Annular balance weight ring 500 is mounted about smaller diameter portion 54*a* in contact with shoulder 541 and annular projection 601. Balance weight ring 500 includes annular depression 501 formed at an inner periphery of the axially rearward surface, reducing the thickness of ring 500 at the inner periphery. Relatively thin plate portion 502 remains at the inner periphery of balance weight ring 500, forward of depression 501. Annular groove 55 is formed in the radially outer peripheral surface of smaller diameter portion 54*a*, and annular snap ring 56 is disposed therein. The radially outer portion of snap ring 56 extends exteriorly of groove 55 and contacts thin plate portion 502 of balance weight ring 500. Thin plate portion 502 of balance weight ring 500 is retained between snap ring 56 and annular shoulder 541. Therefore, balance weight ring 500 is affixed to boss 54 and prevents the axial movement of wobble plate 60. Consequently, an axially rearward end surface of annular projection 601 always contacts the axially forward surface of balance weight ring 500 during operation of the compressor causing friction between annular projection 601 and balance weight ring 500. Excessive rotational friction can occur between annular projection 601 and balance weight ring 500 during compressor operation causing considerable defects such as unusual wear or seizure between annular projection 601 and balance weight ring 500**.

In view of this problem, some compressors in the commercial market are provided with a bearing disposed between the axially rearward end surface of annular projection 601 and the axially forward surface of balance weight ring 500. However, this increases the number of component parts and complicates the assembly process.

SUMMARY OF THE INVENTION

Accordingly, it is an object of the present invention to provide a wobble plate type refrigerant compressor including an annular balance weight ring which can balance a slant plate and prevent the axial movement of a wobble plate under dynamic operating conditions while smoothly rotating on a wobble plate in a bearingless structure.

A wobble plate type compressor in accordance with the present invention includes a compressor housing having a cylinder block. The cylinder block includes a plurality of peripherally disposed cylinders. A crank chamber is enclosed within the cylinder block, forward of the location of the cylinders. The compressor housing includes a suction chamber and a discharge chamber formed therein. A piston is slidably fitted within each of the cylinders, and a drive mechanism is coupled to the pistons to reciprocate the pistons within the cylinders. The drive mechanism includes a drive shaft rotatably supported in the housing, and a coupling mechanism including a slant plate mounted about the drive shaft. The coupling mechanism converts rotational motion of the drive shaft into reciprocating motion of the pistons in the cylinders. The slant plate is disposed at an angle to the drive shaft. The compressor further includes an annular balance weight having a centrally located thin plate region defining a recessed portion. The coupling mechanism further includes a wobble plate disposed about the boss of the slant plate. The annular balance weight is retained on the boss of the slant plate to balance the slant plate and to prevent axial movement of the wobble plate under dynamic operating conditions. The pistons are linked to the wobble plate by connecting rods. The rotational motion of the drive shaft and the slant plate causes the wobble plate to nutate and reciprocate the pistons in the cylinders. The annular balance weight includes a plurality of holes formed at the thin plate region so as to face an end surface of the wobble plate and a tapered annular side wall of the recessed portion in order to efficiently conduct lubricating oil to the friction surface between the wobble plate and the annular balance weight.

DETAILED DESCRIPTION OF THE PREFERRED EMBODIMENTS

Figure 3:
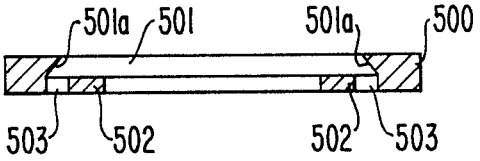
FIG. 3 is a sectional view of the balance weight ring taken along line A—A in FIG. 2.
Figure 4:
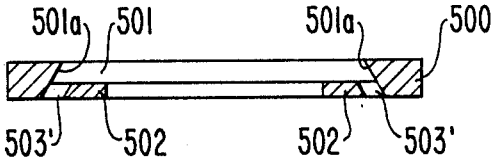
FIG. 4 is a view similar to FIG. 3 showing a second embodiment of the present invention.
Figure 5:
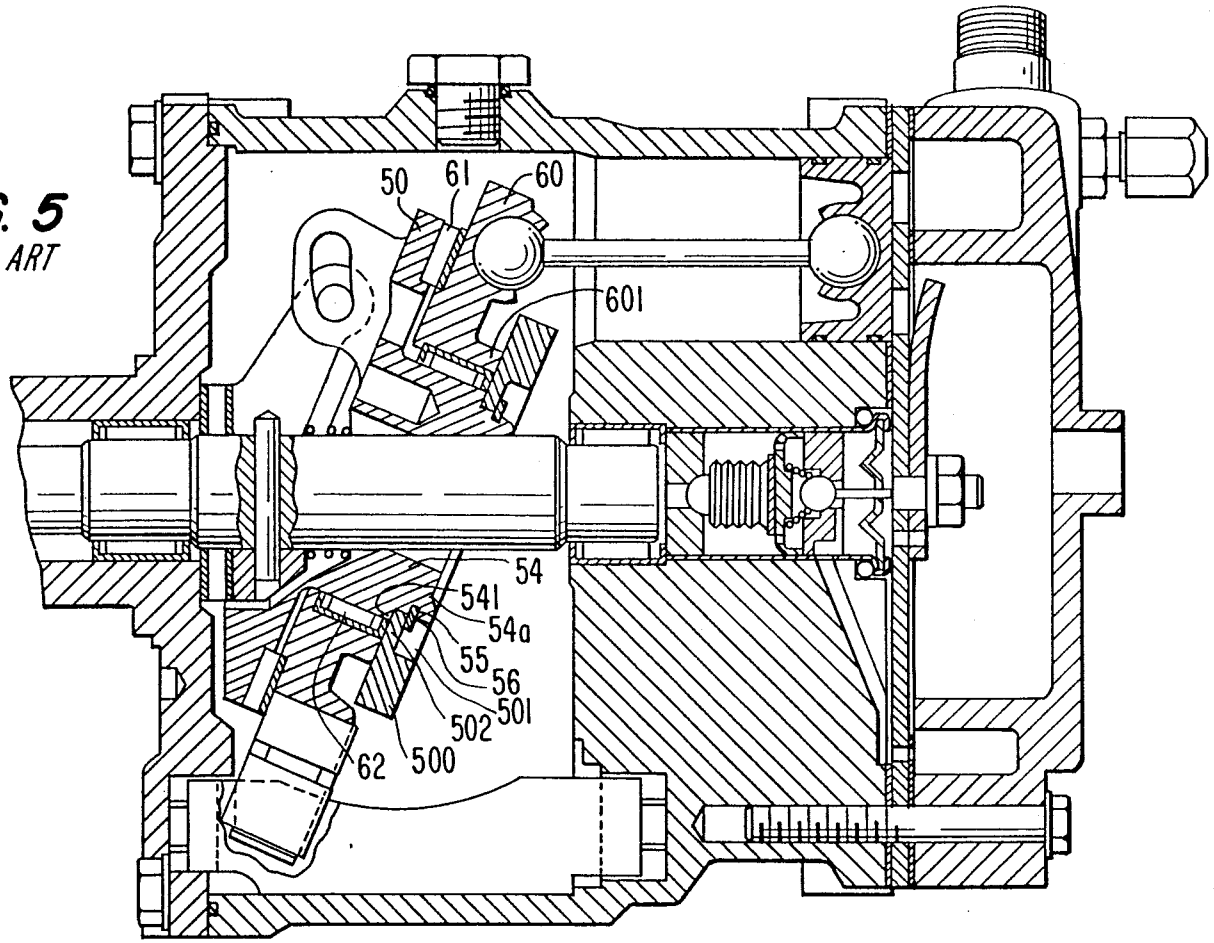
FIG. 5 PRIOR ART
FIG. 5 is a vertical longitudinal sectional view of a wobble plate type refrigerant compressor in accordance with the prior art.

In all of FIGS. 1–4, identical reference numerals are used to denote elements which are identical to the similarly numbered elements shown in the prior art FIG. 5. Additionally, although compressor 10 is shown and is described with respect to FIGS. 1–4 as a wobble plate type refrigerant compressor with a variable displacement mechanism, the invention is not limited thereto and is applicable to a fixed capacity wobble plate type refrigerant compressor. Furthermore, in the following description, the left side of FIG. 1 will be referred to as the front or forward side and the right side will be referred to as the rear side. The term "axial" refers to a direction parallel to the longitudinal axis of the drive shaft, and the term "radial" refers to the perpendicular direction. Of course, all of the reference directions are made for the sake of convenience of description and are not intended to limit the invention in any way.

Figure 1:
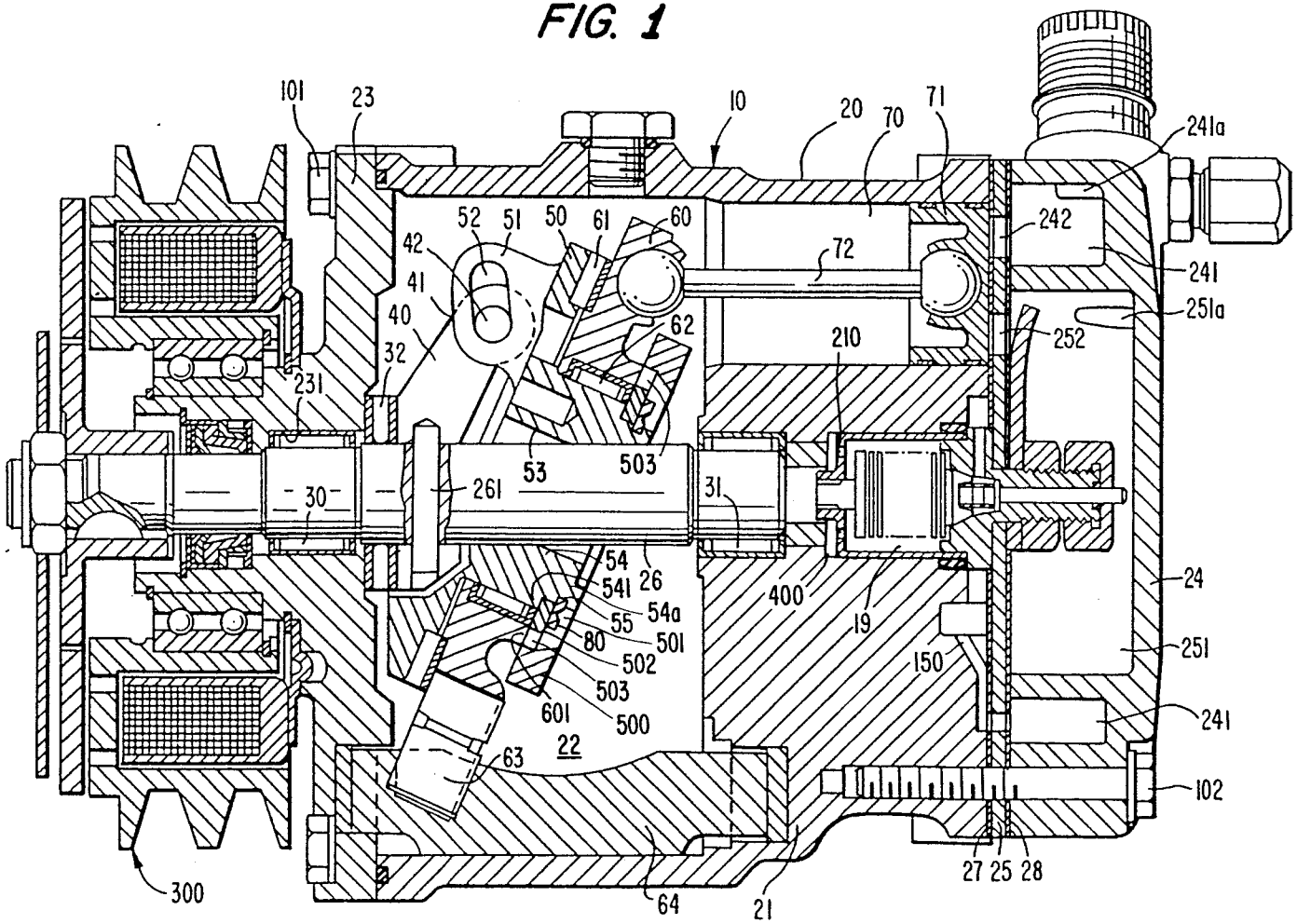
FIG. 1 is a vertical longitudinal sectional view of a wobble plate type refrigerant compressor in accordance with a first embodiment of the present invention.

With reference to FIG. 1, the construction of wobble plate refrigerant compressor 10 in accordance with a first embodiment of the present invention is shown. Compressor 10 includes cylindrical housing assembly 20 including cylinder block 21, front end plate 23 disposed at one end of cylinder block 21, crank chamber 22 formed within cylinder block 21, and rear end plate 24 disposed at the opposite end of cylinder block 21. Front end plate 23 is mounted on the open forward end of cylinder block 21 by a plurality of bolts 101 to enclose crank chamber 22 therein. Rear end plate 24 is mounted on cylinder block 21 at its opposite end by a plurality of bolts 102. Valve plate 25 is located between rear end plate 24 and cylinder block 21. Opening 231 is centrally formed in front end plate 23. Drive shaft 26 is supported by bearing 30 disposed in opening 231. Central bore 210 extends through cylinder block 21 to a rearward end surface. The inner (rear) end portion of drive shaft 26 is rotatably supported by bearing 31 disposed within central bore 210 of cylinder block 21. Valve control mechanism 19 is disposed in bore 210 to the rear of drive shaft 26.

Cam rotor 40 is fixed on drive shaft 26 by pin member 261, and rotates with shaft 26. Thrust needle bearing 32 is disposed between the axial inner (rear) end surface of front end plate 23 and the adjacent forward axial end surface of cam rotor 40. Cam rotor 40 includes arm 41 having pin member 42 extending therefrom. Slant plate 50 is disposed about drive shaft 26 and includes opening 53 through which drive shaft 26 passes. Slant plate 50 is disposed adjacent cam rotor 40. Slant plate 50 includes arm 51 having slot 52 and boss 54. Cam rotor 40 and slant plate 50 are connected by pin member 42, which is inserted in slot 52 to create a hinged joint. Pin member 42 is slidable within slot 52 to allow adjustment of the angular position of slant plate 50 with respect to the longitudinal axis of drive shaft 26.

Wobble plate 60 is mounted about boss 54 of slant plate 50 through bearings 61 and 62 so that slant plate 50 is rotatable with respect thereto. Rotational motion of slant plate 50 causes nutational motion of wobble plate 60. Fork shaped slider 63 is attached to the outer peripheral end of wobble plate 60 and is slidably mounted on sliding rail 64 held between front end plate 23 and cylinder block 21. Fork shaped slider 63 prevents rotation of wobble plate 60 and wobble plate 60 reciprocates along rail 64 when cam rotor 40 and slant plate 50 rotate. Cylinder block 21 includes a plurality of peripherally located cylinder chambers 70 in which pistons 71 reciprocate. Each pistons 71 is connected to wobble plate 60 at a peripheral location by a corresponding connecting rod 72. Nutational motion of wobble plate 60 causes pistons 71 to reciprocate in cylinders 70 to compress refrigerant therein.

Rear end plate 24 includes peripherally located annular suction chamber 241 and centrally located discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as described in U.S. Pat. No. 4,011,029 to Shimizu.

Suction chamber 241 includes inlet portion **241*a* which is connected to an evaporator of the external cooling circuit (not shown). Discharge chamber 251 is provided with outlet portion 251*a* connected to a condenser of the cooling circuit (not shown). Gaskets 27 and 28 are located between cylinder block 21 and the inner surface of valve plate 25, and the outer surface of valve plate 25 and rear end plate 24, respectively, to seal the mating surfaces of cylinder block 21, valve plate 25 and rear end plate 24**.

Communication path 400 links crank chamber 22 and suction chamber 241 and includes central bore 210 and passageway 150. Valve control mechanism 19 controls the opening and closing of communication path 400 in order to vary the capacity of the compressor, as disclosed in Japanese Patent Application Publication No. 01-142,276.

During operation of compressor 10, drive shaft 26 is rotated by the engine of the vehicle through electromagnetic clutch 300. Cam rotor 40 is rotated with drive shaft 26, rotating slant plate 50 as well, causing wobble plate 60 to nutate. Nutational motion of wobble plate 60 reciprocates pistons 71 in their respective cylinders 70. As pistons 71 are reciprocated, refrigerant gas which is introduced into suction chamber 241 through inlet portion **241*a*, flows into each cylinder 70 through suction ports 242 and is compressed therein. The compressed refrigerant gas is discharged into discharge chamber 251 from each cylinder 70 through discharge ports 252, and therefrom into the cooling circuit through outlet portion 251*a***.

The capacity of compressor 10 may be adjusted to maintain a constant pressure in suction chamber 241 in response to a change in the heat load of the evaporator, or a change in the rotating speed of the compressor. The capacity of the compressor is adjusted by changing the angle of slant plate 50 with respect to a plane perpendicular to the axis of drive shaft 26. This angle is dependent upon the crank chamber pressure. An increase in crank chamber pressure decreases the slant angle of slant plate 50 and wobble plate 60, decreasing the capacity of the compressor. A decrease in the crank chamber pressure increases the angle of slant plate 50 and wobble plate 60 and thus increases the capacity of the compressor. In the compressor shown in FIG. 1, valve control mechanism 19 acts in response to the crank chamber pressure, such that the acting point is modified according to the discharge chamber pressure, to control the link between the crank and suction chambers, to adjust the crank chamber pressure and thereby change the slant angle of slant plate 50 and vary the operating capacity of the compressor. Of course other types of valve control mechanisms, or none at all may be used according to the present invention.

Compressor 10 further includes annular groove 55 formed in the radially outer surface of smaller diameter portion **54*a* of boss 54. Boss 54 includes annular shoulder 541 forward of smaller diameter portion 54*a*. Balance weight ring 500 includes annular depression 501 formed at a rearward, radially inner peripheral region, resulting in the thin plate portion 502 formed axially forward of depression 501. Thin plate portion 502 fits on annular shoulder 541 of boss 54. Annular member 80 made of soft metal, for example, untempered iron, disposed on thin plate portion 502** is caulked into groove 55 so as to retain balance weight ring 500 on boss 54 of slant plate 50 by sandwiching thin plate portion 502 against annular shoulder 541. Annular projection 601 is formed at an inner periphery of the axially rearward surface of wobble plate 60 and terminated to the radially outermost of the axially forward surface of thin plate portion 502. Consequently, an axially rearward end surface of annular projection 601 always contacts the radially outermost of the axially forward surface of thin plate portion 502 during operation of the compressor. Thereby, while axial movement of wobble plate 60 is prevented during compressor operation, rotational friction is created between annular projection 601 of wobble plate 60 and thin plate portion 502 of balance weight ring 500.

Figure 2:
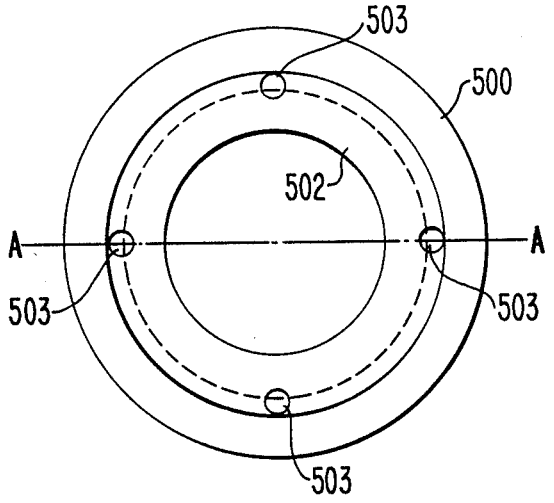
FIG. 2 is a bottom plan view of the balance weight ring shown in FIG. 1.

With reference to FIGS. 2 and 3 additionally, balance weight ring 500 includes annular depression 501 of which annular side wall 501*a* is radially slanted. Thin plate portion 502 is provided with a plurality of axial holes aligned with the periphery of the forward end of side wall 510*a* with an equiangular interval so as to face the rearward end surface of annular projection 601 of wobble plate 60.

with reference to FIG. 1 again, when the compressor operates, the refrigerant mixed with the mists of lubricaing oil (hereinafter, this mixture is represented by "the refrigerant" for explanation only) is introduced into cylinders 70 from suction chamber 241 by the forward motion of pistons 71 and is compressed by the rearward motion of pistons 71. In this situation, a part of the refrigerant is blown into crank chamber 22 from cylinders 70 through the gap between an outer peripheral surface of pistons 71 and an inner peripheral surface of cylinder 70. Then, a part of the refrigerant in crank chamber 22 flows back to suction chamber 241 through communication path 400.

The separation of lubricating oil from the refrigerant which is adjacent to balance weight ring 500 is enhanced by the collision of the refrigerant with balance weight ring 500 due to the rotation of balance weight ring 500. Consquently, the separated oil sticks to the whole external surface of balance weight ring 500, and then moves radially outward by the centrifugal force generated by the rotation of balance weight ring 500.

In particular, the separated oil sticking to the bottom surface of annular depression 501 of balance weight ring 500 moves radially outward and is gathered at the forward end of side wall 501*a* of annular depression 501. The separated oil sticking to annular side wall 501*a* moves forward along a slanted surface of side wall 501*a* due to the centrifugal force and gathers at the forward end of side wall 501*a*. The lubricating oil gathered at the forward end of side wall 501*a* flows into the friction surface between the rearward end surface of annular projection 601 of wobble plate 60 and the forward surface of thin plate portion 502 of blance weight ring 500 through axial holes 503. Accordingly, unusual wear or seizure between annular projection 601 and thin plate portion 502 is prevented without disposing a bearing between the axially rearward end surface of annular projectioin 601 and the axially forward surface of balance weight ring 500, even under extreme conditions.

Since balance weight ring 500 is located near central bore 210, the refrigeratnt adjacent to balance weight ring 500 is always replaced with the fresh refrigerant which is returning to suction chamber 241 from crank chamber 22 through communicating path 400. Therefore, lubricating oil is sufficiently supplied to the friction surface between the rearward end surface of annular projection 601 of wobble plate 60 and the rearward surface of thin plat portion 502 of balance weight ring 500.

FIG. 4 shows a second embodiment of the present invention. In the second embodiment, thin plate portion 502 of balance weight ring 500 is provided with a plurality of inclined holes 503′ aligned with the periphery of the forward end of side wall 501*a* at an equiangular interval. The inclined angle of hole 503′ corresponds to the slant angle of annnular side wall 501*a*, that is, the line extending forward form the forward end of side wall 501*a* corresponds to the raidally outermost line of holes 503′. The lubricating oil gathered at the rearward end of side wall 501*a* is effectively conducted into the friction surface between the rearward end surface of annular projectiion 601 of wobble plate 60 and the forward surface of thin plate portion 502 of balance weight ring 500 through inclined holes 503′ due to centrifugal force.

I claim:

1. In a wobble plate type refrigerant compresor comprising a compressor housing including a cylinder block, said cylinder block including a plurality of pripherally disposed cylinders, a crank chamber enclosed within said cylinder block at a location forward of said cylinders, a piston slidably fitted within each of said cylinders, a drive mechanism coupled to said pistons to reciprocate said pistons within said cylinders, said drive mechanism including a drive shaft rotatably supported in said housing, said drive mechanism further including coupling means for coupling said drive shaft to said pistons such that rotary motion of said drive shaft is converted into reciprocating motion of said pistons in said cylinders, said coupling means including a slant plate disposed on said drive shaft and having a surface disposed at an angle inclined relative to said drive shaft, said slant plate including a boss, an annular balance weight disposed about said boss, said annular balance weight including a central thin plate region defining a recessed portion, and means for retaining said thin plate region on said boss, said coupling means further comprising a wobble plate disposed about said boss, one end surface of said wobble plate rotatably sliding against said thin plate region of said annular balance weight, said pistons linked to said wobble plate by connecting rods, said slant plate rotatable with said drive shaft to enable said wobble plate to nutate to thereby reciprocate said pistons in said cylinders, the improvement comprising:

said annular balance weight including a plurality of holes formed at said thin plate region thereof, peripherally aligned with an annular side wall of said recessed portion and facing said one end surface of said wobble plate.

2. The compressor of claim 1 wherein said similar side wall of said recessed portion is tapered.

3. The compressor of claim 2 wherein each of said plurality of holes has a central axis parallel to an axis of said annular balance weight.

4. The compressor of claim 2 wherein each of said plurality of holes has a central axis inclined with respect to an axis of said annular balance weight at an angle equal to an inclined angle of said annular side wall of said recessed portion of said annular balance weight.

5. The compressor of claim 1 wherein said holes are at least three.

6. The compressor of claim 5 wherein said holes are located with an equiangular interval.

7. A wobble plate type refrigerant compressor comprising:

a compressor housing including a cylinder block, said cylinder blkock including a plurality of peripherally disposed cylinders;

a piston slidably fitted within each of said cylinders;

a crank chamber enclosed within said cylinder block at a location forward of said cylinders;

a drive mechanism enclosed in said crank chamber and coupled to said pistons to reciprocate said pistons within said cylinders, said drive mechanism including a drive shaft rotatably supported in said housing and further including means for coupling said drive shaft to said pistons such that the rotary motion of said drive shaft is converted into reciprocating motion of said pistons in said cylinders, said coupling means further including a slant plate disposed on said drive shaft and having a surface disposed at an angle inclined relative to said drive shaft, said slant plate including a boss;

an annular balance weight disposed about said boss, said annular balance weight including a central thin region defining a recessed protion;

means for retaining said thin plate region of said annular balance weight on said boss, said coupling means further comprising a wobble plate disposed about said boss, one end surface of said wobble plate rotatably sliding against said thin plate region of said annular balance weight, said pistons linked to said wobble plate by connecting rods, said slant plate rotatable with said drive shaft to enable said wobble plate to nutate to thereby reciprocate said pistons in said cylinders; and said annular balance weight including a plurality of holes formed at said thin plate region thereof, peripherally aligned with an annular side wall of said recessed protion and facing said one end surface of said wobble plate.

8. The compressor of claim 7 wherein said annular side wall of said recessed portion is tapered.

9. The compressor of claim 8 wherein each of said plurality of holes has a central axis parallel to an axis of said annular balance weight.

10. The compressor of claim 8 wherein each of said plurality of holes has a central axis inclined with respect to an axis of said annular balance weight at an angle equal to an inclined angle of said annular side wall of said recessed portion of said annular balance weight.

11. The compressor of claim 7 wherein said holes are at least three.

12. The compressor of claim 11 wherein said holes are located at an equiangular interval.

* * * * *